United States Patent [19]

Oshima et al.

[11] 4,198,917

[45] Apr. 22, 1980

[54] ICE-BREAKING MEANS FOR SHIPS

[75] Inventors: Masanao Oshima; Mikihisa Komoto; Shoichi Yabuki; Tsuneo Inokawa, all of Tokyo, Japan

[73] Assignee: Mitsui Engineering and Shipbuilding Co., Ltd., Tokyo, Japan

[21] Appl. No.: 823,396

[22] Filed: Aug. 9, 1977

[30] Foreign Application Priority Data

Aug. 9, 1976 [JP] Japan ..... 51-94684
Aug. 9, 1976 [JP] Japan ..... 51-94685

[51] Int. Cl.[2] ..... B63B 35/08

[52] U.S. Cl. ..... 114/42; 115/19; 299/24; 115/1 R

[58] Field of Search ..... 114/40, 42; 115/1 R, 115/19, 20, 34 R, 34 A, 37, 38; 299/24, 25, 75, 28; 175/18

[56] References Cited

U.S. PATENT DOCUMENTS

| | | | |
|---|---|---|---|
| 958 | 10/1838 | Hunt | 114/40 |
| 1,041,232 | 10/1912 | Berry | 115/19 |
| 2,665,655 | 1/1954 | Brown | 114/42 |
| 3,229,658 | 1/1966 | Schrader | 115/19 |
| 3,250,239 | 5/1966 | Garate | 115/19 |
| 3,381,650 | 5/1968 | Itoh | 115/19 |
| 3,632,172 | 1/1972 | Robinson | 114/42 |

*Primary Examiner*—Charles E. Franfort
*Assistant Examiner*—D. W. Keen
*Attorney, Agent, or Firm*—Armstrong, Nikaido, Marmelstein & Kubovcik

[57] ABSTRACT

Disclosed are ice-breaking units for ships adapted to be installed at the bow and/or bottom portion of the ship's hull, consisting of two ice-breaking units each of which can be reversibly driven independently of each other, for performing ice-breaking and/or propulsion of the ship. The ice-breaking unit has a screw-like body having a spiral blade wound thereabout. The ice-breaking units may be disposed at the bow portion, at both sides of the longitudinal center line of the ship, in parallel with or normal to the latter, or may be arranged to have a propulsion portion and an ice-breaking portion, respectively. The two screw-like bodies may be driven simultaneously in the same direction or reversed, or may be rotated in the opposite directions, to provide thrusts to move the ship in any direction of ahead/astern and port/starboard.

4 Claims, 25 Drawing Figures

ICE-BREAKING MEANS FOR SHIPS

BACKGROUND OF THE INVENTION

The present invention relates to ice-breaking means and, more particularly, ice-breaking means adapted for use on ships which act mainly in icy sea area, e.g., oil-rig vessels for polar oil fields and amphibian supply boats for cargo transportation.

Conventionally, oil-rig vessels and supply boats for use in icy sea areas have been constructed as ice breakers or designed to have ice-breaking function.

In these conventional ice-breaking ships, the wedging and ice-breaking are performed by means of the kinetic energy possessed by the ship herself and, therefore, the ship herself must be fully equipped for ice breaking. To this end, it has been necessary to make the ship's size considerably large, or to provide the ship with a large propulsion power to obtain a speed high enough to cause an effective ice-breaking force when colliding and impinging upon the mass of ice.

However, these conventional measures are quite incompatible with the requisites for oil-rig vessels under operation. Namely, oil-rig vessels have to keep the position for continuing the operation and, therefore, do not move so largely. Thus, ice-breaking relying upon the kinetic energy of the ship cannot be effectively used for oil-rig vessels, especially when it is under operation.

Also, it is not a good policy to make the ship's hull large, especially in case of supply boats intended for relatively small scale of cargo transportation, because the enlarged size inevitably leads to an uneconomically high cost and other inconveniences.

It is therefore an object of the invention to provide ice-breaking means suitable for use for oil-rig vessels, which can afford the ice breaking without the movement of the ship's hull itself.

It is another object of the invention to provide ice-breaking means for ships capable of performing multiple functions of breaking ice, propulsion of the ship and turning of the ship.

It is still another object of the invention to provide ice-breaking means which do not necessitate to make the ship large and, accordingly, suitable for use on ships such as supply boats intended for transportation of small scale.

BRIEF SUMMARY OF THE INVENTION

Ice-breaking means in accordance with the invention have at least a pair of ice-breaking units, each of which is provided with a screw body having a spiral blade therearound, known as so-called Archimedean Screw. The ice-breaking means are installed at the bow and/or bottom portion of the ship, in such a manner that two ice-breaking units may be driven in the same or opposite rotational directions independently of each other.

The ice-breaking units may be disposed in parallel with or right angles to the central axis line of the ship. Thus, thrusting force of any desired direction can be obtained by driving the ice-breaking units simultaneously in the same rotational direction or reversing them simultaneously, or by driving them in the opposite rotational directions, for propelling the ship ahead or astern, or turning the ship port or starboard, as desired.

The ice-breaking means of the invention can be arranged such that each ice-breaking unit has an ice-breaking portion located at the bow portion and a propulsion portion located at the bottom of the ship, so that the ice-breaking and the propulsion portions may perform mainly the ice-breaking and propelling functions respectively. In this case, ballast means are preferably used for adjusting the trim of the hull.

DESCRIPTION OF THE PREFERRED EMBODIMENTS

Figure 1:
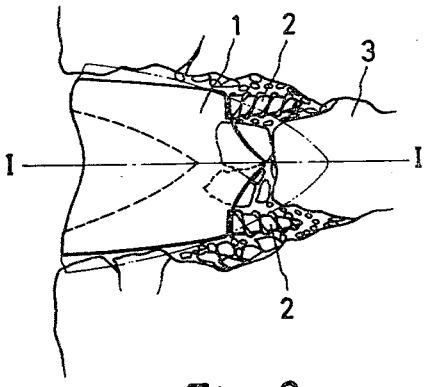
FIGS. 1 and 2 are respectively a partial plan view and a partial side elevational view of ice-breaking means embodying the present invention applied to an oil-rig vessel.
Figure 2:
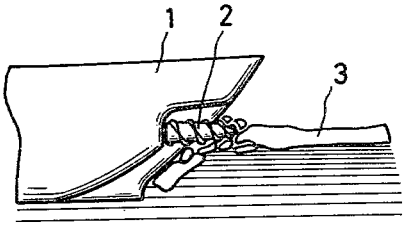

Referring at first to FIGS. 1 and 2 showing a first embodiment of the invention applied to an oil-rig vessel, the ice-breaking means of the invention has a pair of screw bodies, each of which consists of a conical drum body and a herical or spiral blade fixedly wound thereabout. This type of screw body has been known as "Archimedean Screw."

The pair of screw bodies 2 are disposed at both sides of the longitudinal center line of the rig 1, with their axes put in parallel with the latter, at the bow portion of the rig 1.

The screw bodies 2 have the spiral screws which are wound in opposite directions, and are connected to driving means constituted by electric motors or engines, so that they may be driven in the same or opposite rotational directions irrespective of each other, thereby to break the mass of ice 3. More specifically, two grooves are formed by the rotation of the two screws 2, on the mass of ice 3, and the portion of the ice 3 between the two grooves is bent and broken, as it is forced to lie beneath the bow portion of the rig 1.

Figure 5:
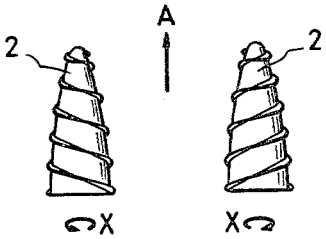
FIGS. 5*a* to 5*d* are illustrations for explaining the generation of thrusting force in the first embodiment of the invention.
Figure 5:
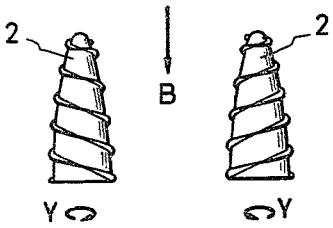
Figure 5:
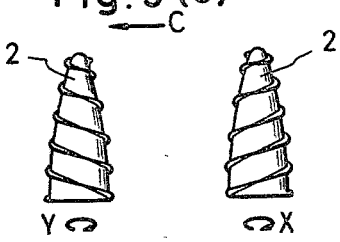
Figure 5:
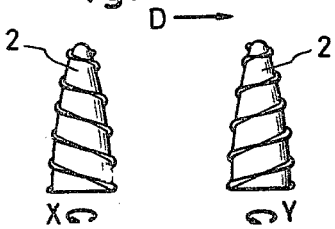

By suitably combining the rotational directions of the screw bodies 2, the rig can be moved ahead and astern, and can be steered port and starboard, as shown in FIG. 5 which is top plan view of the screw bodies 2.

Namely, a thrust indicated at A is generated to pull the rig ahead, when the screw bodies 2 are rotated in the direction X as shown in FIG. 5*a*, while a thrust B for pushing the rig astern is caused when the screw bodies are reversed as denoted by Y in FIG. 5*b*. At the same time, a thrust C for turning the rig starboard is obtained by reversing the left-hand side screw body as Y and driving the right-hand side screw body in the ordinary direction X, as shown in FIG. 5*c*. A thrust D for turning the rig port results from rotating the screw bodies 2 in the opposite directions to those of FIG. 5*c*, respectively, as shown in FIG. 5*d*.

Thus, according to the invention, thrusting and propelling forces are obtained in all desired directions, so as to enable the rig to keep its position correctly (this is a primary and essential function required for oil-rig vessels), breaking the mass of ice as required, without using conventional side thruster which is much more likely to be damaged by ice than the screw bodies of the invention. In addition, the resultant propelling force is effective to propel the rig, when the rig goes icy sea area, breaking ice masses. If the thrust produced during the ice-breaking is to be eliminated for keeping the position of the rig, the screw bodies are reversed, i.e., rotated in the direction Y, respectively, so that the resultant thrust may be negated by a thrust provided by main propelling screws.

Figure 3:
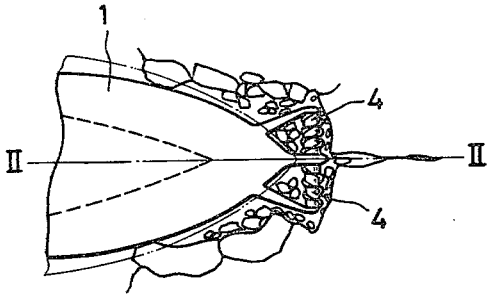
FIGS. 3 and 4 are a partial plan view and a partial side elevational view of a second embodiment of the invention, respectively.
Figure 4:
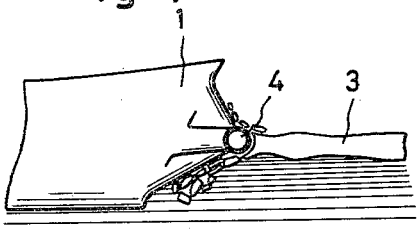

Referring now to FIGS. 3 and 4 showing a second embodiment of the invention, two screw bodies 4 forming a pair are disposed to lie at right angles to the central axis line II—II of the oil-rig vessel, respectively, at the bow portion of the latter. In this embodiment, the mass of ice is broken directly by the screw bodies themselves. Also, four directions of thrusts are obtained, as is in case of the foregoing first embodiment, by suitably combining the directions of rotation of the screw bodies.

Figure 6:
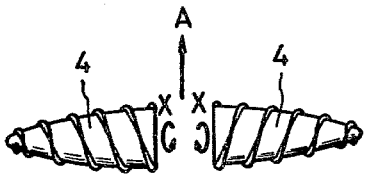
FIGS. 6*a* to 6*d* are illustrations for explaining the generation of thrusting force in the second embodiment.
Figure 6:
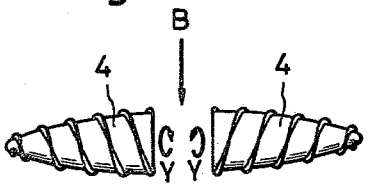
Figure 6:
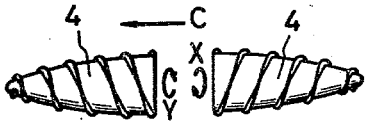
Figure 6:
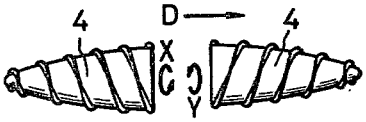

More specifically, for selectively imparting rotations in X and Y directions in the same manner as the case of FIG. 5, forward and rearward thrusts A and B, as well as port and starboard steering thrusts D and C are obtained, as will be seen from FIG. 6. These thrusts are of course effective to keep the position of the rig constant and to propel the rig in the icy sea area, as is the case of the aforementioned first embodiment.

Figure 7:
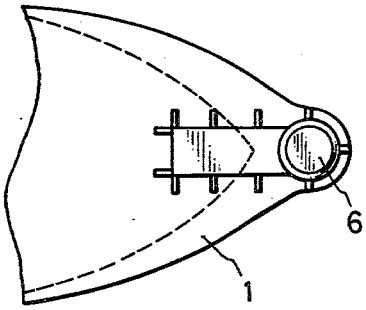
FIGS. 7 and 8 are a partial plan view and a partial side elevational view, respectively, of a modification in which a vertical screw is provided at the bow portion.
Figure 8:
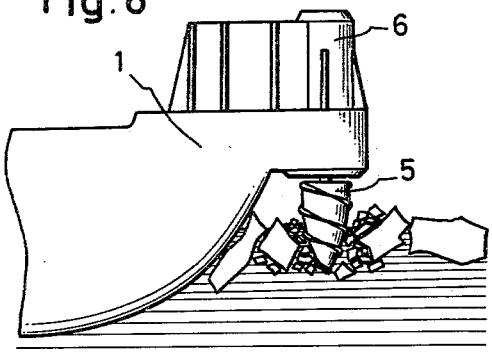
Figure 9:
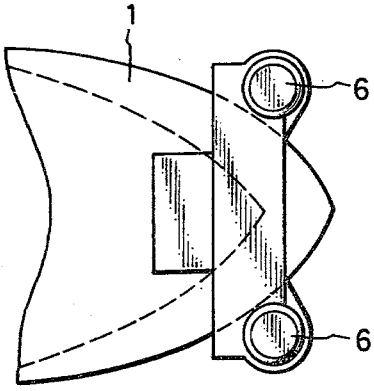
FIG. 9 is a plan view of another modification in which a pair of vertical screws are provided at the bow portion.

FIGS. 7 and 8 show a modification in which a screw 5 is provided at the bow portion to extend vertically. As the oil-rig enters the icy sea area, the screw 5 is lowered to the level of the water surface, by actuating lifting/-lowering means 6. Thus, the screw 5 is started as the mass of ice 3 comes to collide with the oil-rig vessel, so as to break the latter. In another modification shown in FIG. 9, the vertical screws are arranged in a pair. In this case, the variable thrusting force as obtained in the foregoing first and second embodiments cannot be expected. However, since the ice-breaking function is performed directly and mechanically by means of the screws, the drawbacks inherent in the conventional ice-breaking relying upon the ship's kinetic energy can conveniently be avoided.

As will be seen from the foregoing description, according to the present invention the oil-rig vessel in icy sea areas can break the surrounding ice without moving back and forth, i.e., keeping its constant position. Needless to say, this feature is advantageous especially for oil-rig vessels which are strictly required to keep the position during drilling operation, and the ice-breaking means of the invention are especially suitable for those vessels.

In addition, the ice-breaking screw bodies can exert effective propulsion force for propelling the ship in the icy sea area. This thrust can be expected in all directions, not only to move the vessel ahead and astern, but to turn the vessel port and starboard when the screw bodies are used in the submerged condition, so as to greatly improve the maneouverability of the vessel which is highly desirable particularly in icy sea areas.

Thus, these two advantageous features ensure a remarkable effect when the ice-breaking means of the invention are applied to oil-rig vessels intended for use in icy sea areas and, therefore, afford a highly practical merit.

In the foregoing two embodiments, the ice-breaking means of the invention are installed on a vessel which is required to maintain her position constant, typically an oil-rig vessel, to provide a specifically advantageous effect. However, the invention is applicable also to small-sized ships which are bound to run in an icy area, including barges, in which screw bodies also perform the advantageous double function of ice-breaking and propulsion.

Figure 10:
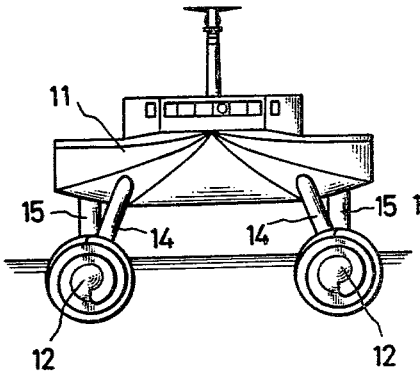
FIGS. 10 and 11 are a front elevational view and a side elevational view, respectively, of a supply boat incorporating ice-breaking means which constitute a third embodiment of the invention.
Figure 11:
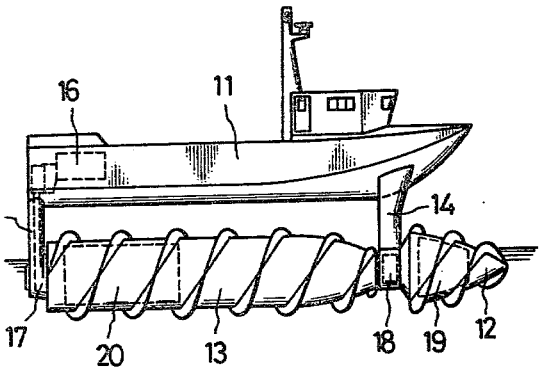

Namely, referring now to FIGS. 10 and 11 showing a third embodiment of the invention, the ice-breaking means of the invention are applied to an amphibian supply boat adapted for use in cargo-transportation of a relatively small scale. In this embodiment, the ice-breaking means have two ice-breaking units each of which consists of the "Archimedean Screw." However, in this embodiment, each screw body is divided into two positions 12 and 13, and is installed to extend from the bow to the bottom of the boat's hull 11 which is designed to withstand the wave impact and to exhibit a good stability.

The portion 12 of the screw body is intended mainly for the ice-breaking function and constitutes a bow-buoyant screw which imparts a buoyancy when the boat is afloat, while the portion 13 of the screw body chiefly performs the propulsion and constitutes a stern-buoyancy screw for imparting a buoyancy to the stern portion of the boat. The buoyant screws 12 and 13 are provided therein with ballast tanks 19, 20 for suitably adjusting the buoyancy and, accordingly, the trim of the boat.

The pair of the bow-buoyant screw 12 and the stern-buoyant screw body 13 are installed at sides of the boat's hull 11, at the bottom portion of the latter, such that the helical or spiral blades of the screw bodies of both sides are formed in opposite directions of twist. These screw bodies are secured to and suspended from the hull 11 through bow and stern struts 14 and 15.

Suitable driving power source such as an engine 16 is accommodated in the hull 11, so as to transmit a driving power to the stern-buoyant screws 13, through a transmission 17. The power is then delivered from the stern-buoyant screws 13 to respective bow-buoyant screws 12, through specific transmissions 18 acting between the bow and the stern buoyant screws 12 and 13. The transmission 18 consists of clutches and speed-increasing gears of variable ratio, and adapted to be controlled from the operator's seat aboard for desired speed-increasing ratio.

Figure 12:
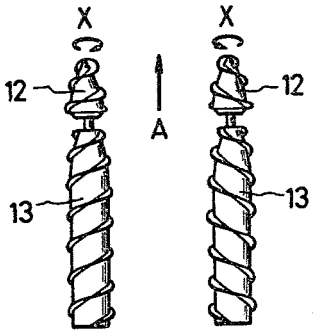
FIGS. 12*a* to 12*d* are illustrations explaining the generation of the thrusting force in the third embodiment of the invention.
Figure 12:
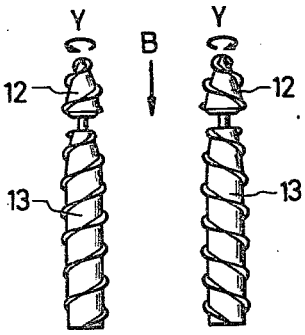
Figure 12:
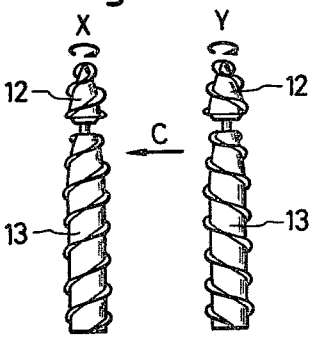
Figure 12:
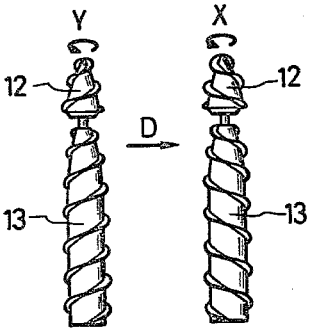

In operation, the port and starboard sides screw bodies each of which consists of the bow and the stern buoyant screws 12, 13 are driven by the driving power source through the transmissions. The screw bodies can be rotated independently of each other, by suitably switching the transmissions, in such a manner that they are simultaneously driven in the ordinary direction of rotation or reversed, or one is rotated ordinary while the other is reversed. Therefore, the hull 11 can be propelled and steered in any desired direction as the ship is on the mass of ice or on the sea with the buoyant screws 12, 13 partially submerged, by suitably combining the directions of rotation of the port and the starboard side screw bodies. More specifically, referring to FIG. 12 showing a top plan view of the buoyant screws 12 and 13, a thrusting force A for pulling the boat ahead is caused when the both screw bodies are rotated in the direction X as shown, respectively, in FIG. 12*a*, while a thrusting force B for pulling the boat astern is obtained by rotating both screws bodies in Y direction, respectively, as shown in FIG. 12*b*.

At the same time, the boat will be steered starboard by the thrusting force C which is obtained when the port-side screw body 12, 13 is rotated in the direction X, while the starboard-side screw body 12, 13 is reversed, i.e., rotated in the direction Y, as shown in FIG. 12*c*. Similarly, the boat will be steered port by a thrusting force D, which is generated by rotating the port and starboard screw bodies in Y and X directions, respectively, as shown in FIG. 12*d*. Thus, when the boat is confined by masses of ice, the boat can be moved ahead and astern and, in addition, laterally in both directions, to more effectively cope with the circumstances than conventional boats.

Figure 13:
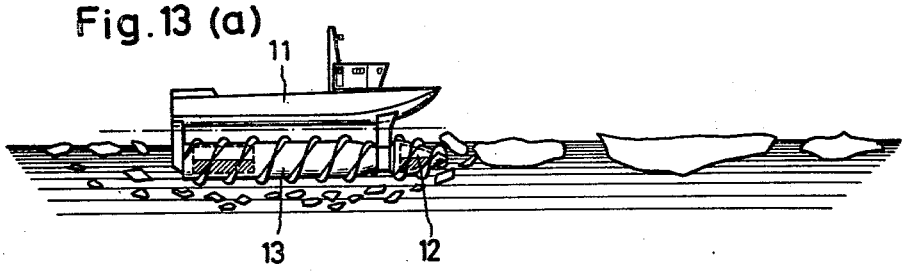
FIGS. 13*a* to 13*d* are illustrations explanatory of the operation of a supply boat to which the invention is applied.
Figure 13:
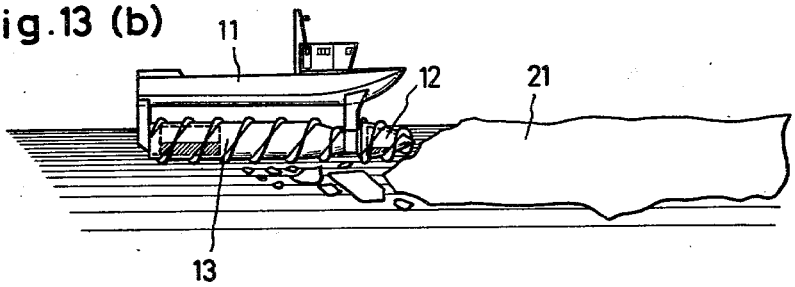
Figure 13:
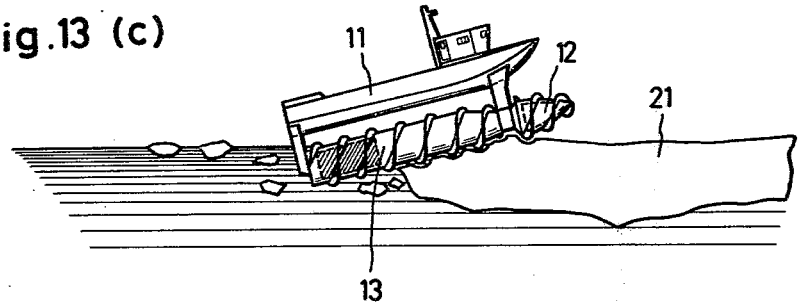
Figure 13:
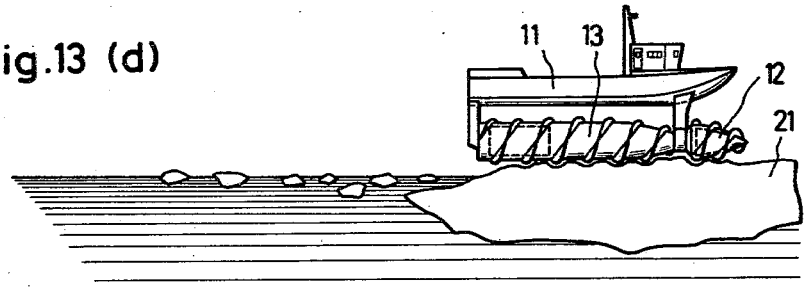

Modes of operation of the supply boat incorporating the ice-breaking means of the invention will be described hereinafter with specific reference to FIG. 13.

For the normal running in the open sea area, the fore and aft ballast tanks accommodated in the bow and the stern buoyant screws 12, 13 are filled with sea water, so that the whole part of the screws 12, 13 at each side of the boat may be submerged. Then, the hull 11 can run stably, without being substantially affected by wave impacts.

For going in icy sea area, the ballast tanks are so adjusted to put the buoyant screws half submerged, so that the ice breaking may be performed chiefly by the bow-buoyant screws 12 at both sides, as required, as shown in FIG. 13*a*.

When the boat is encountered by a large mass of ice difficult to break, the fore ballast tanks are partially evacuated to trim the hull to allow the bow-buoyant screws 12 to cut the upper edge of the ice upwardly. This cutting will be performed more effectively, when the bow-buoyant screws 12 are driven at a higher speed than the stern buoyant screws, by suitably operating the transmissions 18, as shown in FIG. 13*b*.

Then, also the stern buoyant screws 13 come to ride on the ice, as shown in FIG. 13*c*, by further trimming the boat by the stern.

Finally, the boat climbs and gets on the ice, as the ballast water is completely discharged, to run on the ice, as shown in FIG. 13*d*.

As has been described, the supply boat incorporating the ice-breaking means of the invention is superior to the conventional ice-breaking or anti-ice supply boats for cargo transportation, in that it can be steered easily ahead and astern, and port and starboard, which is specifically advantageous when the boat is surrounded by ice masses, thereby to ensure a more efficient cargo transportation over the conventional supply boats.

In addition, since the ice-breaking relies upon the mechanical direct breaking performed by the screw bodies, and not on the kinetic energy possessed by the boat's hull, the supply boat incorporating the ice-breaking means of the present invention can exert a large ice-breaking power for its small size. Further, when the objective ice is thick and difficult to break, the boat can climb and get on the ice to run on the ice. Thus, according to the invention, the supply boat is afforded to perform various modes of operation to greatly contribute to the cargo-transportation in the icy sea area.

Having described the invention through specific embodiments, it is to be noted here that they are not exclusive and may be suitably combined and modified without departing from the scope of the invention.

Thus, the ice-breaking means of the invention are basically characterized in that a pair of ice-breaking units each of which has a screw body having a peripheral spiral blade, i.e., an Archimedean Screw, one unit being located at each side of the ship's hull, the blades of both screw bodies being oriented in opposite directions, so that thrusts for moving the ship ahead and astern, as well as port and starboard, may be obtained as desired by suitably selecting the direction of rotation of the screw bodies.

Thus, the essential factor of the invention resides in the provision of a pair of screw bodies having a peripheral spiral bodies. Therefore, at least one similar screw body may be added thereto.

At the same time, it is possible to use the screw bodies of FIGS. 1 and 2 in combination with those of FIGS. 3 and 4, or to use the screw bodies of FIGS. 3 and 4 in combination with those of FIGS. 7 and 8.

It is essential to select the combination of screw bodies so as to obtain good ice-breaking power, propulsion force and the manouverability of the ship.

Further changes and modifications are of course possible without substantially departing from the scope of the invention which is to be delimited solely by the appended claims.

What is claimed is:

1. An ice-breaking device for a ship comprising at least a pair of ice-breaking means, each having a screw body, in the form of a rotatable cone, supported only at the base thereof, provided with a peripheral spiral blade extending to the tip thereof, wherein said screw bodies, with said spiral blades thereon, are positioned such that they extend beyond the periphery of the bow portion of the ship with the axes of the screw bodies being in parallel with, and spaced from, the central axis line of said ship, at the respective sides of said central axis line, said ice-breaking means forming grooves in a mass of ice by the rotation of the screw bodies on the mass of ice, and driving means for driving said ice-breaking means independently of each other in the same or opposite directions of rotation, wherein a portion of the mass of ice between the grooves formed therein is bent and broken by the force applied thereto by said ice-breaking means and said bow, said portion of ice being forced beneath the bow portion of said ship.

2. An ice-breaking device as claimed in claim 1, wherein said screw bodies extend below the bottom of said ship, each screw body having a bow portion adapted primarily for ice-breaking and a bottom portion for exerting a propulsion force.

3. An ice-breaking device as claimed in claim 2, wherein said bow and bottom portions of said screw bodies are buoyant and include a ballast tank within said screw bodies.

4. An ice-breaking device for a ship comprising at least a pair of ice-breaking means each having a screw body, in the form of a cone, provided with a peripheral spiral blade, said ice-breaking means being positioned at and extending beyond the periphery of the bow portion of the ship with the axes of the screw bodies lying in a vertical plane, said axes being perpendicular to and spaced from the central axis line of said ship, said screw bodies adapted to be raised and lowered at the respective sides of said central axis line, said ice breaking means forming grooves in a mass of ice by the rotation of the screw bodies on the mass of ice, and driving means for driving said ice-breaking means independently of each other in the same or opposite directions of rotation, wherein a portion of the mass of ice between the grooves formed therein is bent and broken by the force applied thereto by said ice breaking means said portion of ice being forced beneath the bow portion of said ship.

* * * * *